United States Patent [19]

Schieman

[11] 4,402,841

[45] Sep. 6, 1983

[54] EXTENDED SERVICE 5W-40 MOTOR OIL

[75] Inventor: Richard D. Schieman, Rocky River, Ohio

[73] Assignee: The Standard Oil Company, Cleveland, Ohio

[21] Appl. No.: 348,896

[22] Filed: Feb. 16, 1982

[51] Int. Cl.[3] ..... C10G 71/00; C10M 1/48; C10M 3/42

[52] U.S. Cl. ..... 252/46.6; 252/51.5 R; 252/56 R; 208/19

[58] Field of Search ..... 208/19; 252/46.6

[56] References Cited

U.S. PATENT DOCUMENTS

| | | | |
|---|---|---|---|
| 2,360,446 | 10/1944 | Reid | 208/19 |
| 3,303,125 | 2/1967 | Marter | 208/19 |
| 3,493,505 | 2/1970 | Ries, Jr. | 208/19 |
| 3,640,868 | 2/1972 | Rocchini | 208/19 |
| 3,904,507 | 9/1975 | Mills | 208/19 |
| 3,915,871 | 10/1975 | Bryer et al. | 208/19 |
| 3,970,543 | 7/1976 | McIntosh | 208/19 |
| 3,992,283 | 11/1976 | Hutchings | 208/18 |
| 4,157,294 | 6/1979 | Iwao et al. | 208/19 |
| 4,213,845 | 7/1980 | Masada | 208/19 |

*Primary Examiner*—Delbert E. Gantz
*Assistant Examiner*—Helane E. Maull
*Attorney, Agent, or Firm*—W. A. Heidrich; Herbert D. Knudsen; Larry W. Evans

[57] ABSTRACT

An extended drain 5W-40 motor oil composition for internal combustion engines comprises a base oil component of one or more solvent extracted mineral oils and a high refractory mineral oil, a V.I. improver, and preferably other suitable lube oil additives. The finished oil formulation has characteristics of minimal viscosity at low temperatures, low volatility at higher temperatures, and stable viscosity over extended use.

36 Claims, No Drawings

EXTENDED SERVICE 5W-40 MOTOR OIL

BACKGROUND OF THE INVENTION

1. Field of the Invention

This invention relates to a motor oil composition for internal combustion engines. More particularly, this invention relates to an SAE 5W-X multi-grade motor oil where the 5W base oil is blended to produce, for example, oils of SAE number 20, 30, 40 or 50. In one aspect this invention relates to a SAE 5W-40 grade oil which has a low phosphorus and nitrogen content, low consumption rate, minimal high temperature volatility, and which demonstrates retained viscosity characteristics over extended use.

2. Discussion of the Art

Lubricating oils must provide minimal frictional wear in an engine over a wide range of operating temperatures. These engine temperatures can range from below freezing during cold weather starting to above 400° F. (200° C.) during severe usage. A multi-grade blend of oils and additives is usually required to provide both low temperature cranking properties and thermal stability at higher temperatures.

A continuing problem in the art is formulating a multi-grade oil which will maintain all of the desired characteristics, i.e. low viscosity at starting temperatures and high viscosity with low volatility at operating temperatures, without sacrificing or compromising any of them. Although such oil blends could be formulated from natural petroleum stocks by the addition of viscosity index improvers, a large amount of lower molecular weight polymers would be needed to provide the lower viscosity at low operating temperatures. Unfortunately the shear stability of these lower molecular weight polymers is poor and the polymer chains often cleave at higher temperatures, destroying the 5W properties of the oil.

Another problem associated with formulations containing a 5W oil is consumption and short useful life. The oil blends necessary for low viscosity at low temperatures usually suffered from high volatility at higher engine operating temperatures.

The viscous detergent-dispersant additives also had to be kept to a minimum amount to meet the viscosity requirements of a 5W oil. Such minimal amounts were often insufficient to keep the engine clean over extended use.

Many petroleum additives contain phosphorus compounds, yet phosphorus is known to poison catalysts used in automobile exhaust converters. Increasing restrictions on automobile emissions will require that modern multi-grade motor oils contain little or no phosphorus while maintaining desirable viscosity characteristics. An increasing demand for light viscosity base stocks will also be seen as the auto industry moves toward cars with small four-cylinder engines. Improved fuel economy is a benefit of using the lower viscosity oil, as well as easier cold starting, sustained firing and extended battery life.

SUMMARY OF THE INVENTION

The base oil of this invention suitable for use in a 5W-40 motor oil comprises a mixture of a high refractory petroleum fraction and an SEN oil fraction. Preferred formulations have a V.I. improver and multifunctional detergent-dispersant-inhibitor additives of a type and amount which will result in an extended drain multigrade oil having low phosphorus, thermal stability, and retained viscosity over use.

DETAILED DESCRIPTION OF THE INVENTION

I. BASE OIL COMPONENT

The base oils of the inventive multi-grade motor oil are homogeneous mixtures of different petroleum-derived hydrocarbons which are predominantly saturated and exhibit an essentially continuous molecular weight distribution. These base oils exhibit properties set forth in Table 1.

| BASE OIL PROPERTIES | General | Preferred | Optimal |
|---|---|---|---|
| Minimum 300° F. (148.9° C.) Viscosity, centistokes | 1.5 | 2.0 | 2.4 |
| Maximum Basic Nitrogen Content, ppm | 60.0 | 45.0 | 35.0 |

In accordance with the invention, the base oil of the inventive oil is composed of a high refractory petroleum fraction and a solvent extracted neutral (SEN) oil fraction. SEN oils are well-known standard mineral oil refinery stocks derived from the vacuum distillation column of a refinery. They have been used for many years to form the base oils of lubricating oils, and it is well known to formulate 10W40 motor oils using one or more SEN oils as the base stock.

Unfortunately, it is difficult if not impossible to get 5W viscosity characteristics from SEN oils since they exhibit too high a viscosity at low temperatures or contain excessive quantities of low boiling components at low viscosities. In accordance with the present invention, a high refractory petroleum fraction having a unique combination of properties, i.e. low viscosity at low temperature but minimal boil-off at 700° F. (371° C.), is added to the SEN oil to form a completed base oil having relatively low viscosity at low temperatures and limited boil-off at elevated temperature, e.g. 700° F. (371° C.).

A. High Refractory Petroleum Fraction

The high refractory petroleum fraction contemplated for use in the present invention has a unique combination of properties. Specifically, this fraction is characterized as set forth in Table 2.

TABLE 2

| HIGH REFRACTORY PETROLEUM FRACTION PROPERTIES | General | Preferred | Optimal |
|---|---|---|---|
| Maximum 0° F. (−17.8° C.) Viscosity, poise | 7.0 | 6.0 | 5.0 |
| Maximum 100° F. (37.8° C.) Viscosity, SUS | 94.0 | 85.0 | 85.0 |
| Maximum Boil-Off at 700° F. (371° C.), percent | 16.0 | 13.0 | 10.0 |
| Maximum Boil-Off at 760° F. (403.9° C.), percent | 70.0 | 60.0 | 50.0 |
| Minimum Viscosity Index | 100.0 | 100.0 | 100.0 |

An example of a petroleum stream which will provide a high refractory fraction meeting the above criteria is the dewaxed, dearomatized and optionally clay-contacted bottoms fraction obtained by distilling the effluent of a hydrocracker operating in the gasoline production mode and using a catalyst composed of nickel-tungsten or nickel-molybdenum supported on zeolite.

As well known to those skilled in refining, hydrocracking is a conventional refinery operation similar to catalytic cracking except that hydrogen is supplied to the reaction system. An example of a hydrocracking system suitable for obtaining the high refractory fraction used in this invention is the Chevron Isocracking Process as described in *Hydrocarbon Processing,* Vol 53, No 9 (September 1974), incorporated by reference. The process can be conducted in a single stage which utilizes a single reactor, or in a two stage operation with two reactors. For purposes of this invention, a two-stage hydrocracking operation is preferred.

In normal operation, i.e. in the "gasoline production" mode intended to maximize the amount of gasoline produced, the feed to the hydrocracking system is a gas oil fraction obtained from an atmospheric crude distillation tower. The effluent from the hydrocracker(s) is usually stabilized to remove entrained gases and then distilled in a splitter to produce a number of different components: e.g., a light gasoline, a heavy gasoline, a kerosene fraction and a bottoms.

This hydrocracker distillate bottoms, or splitter bottoms, is often recycled and mixed with the fresh feed to the hydrocracker reactor(s), where theoretically it is recycled to extinction. The splitter bottoms, normally having an initial boiling point of 400° to 450° F. (200° to 230° C.), is a preferred source in accordance with the present invention for producing the high refractory petroleum fraction. The bottoms fraction from hydrocracked gas oil as described in U.S. Pat. No. 4,234,409 to Schieman et al., the disclosure of which is incorporated by reference, is one source of the hydrocracker distillate bottoms.

As indicated above, a hydrocracker when used to produce a high refractory fraction in accordance with the present invention is operated in the gasoline production mode. Hydrocrackers have in the past been used to produce feedstocks for lubricating oil manufacture, but such operation requires rather extreme operating conditions, e.g. 300 Standard Cubic Feet (SCF) $H_2$ per barrel of feed and 900° F. (482° C.) temperatures. Such operation is uneconomical and is not used commercially to any significant extent. In making the high refractory fraction used in the inventive base oil, a hydrocracker is operated under normal conditions, i.e. in the gasoline production mode, where the operating conditions are much milder, e.g. 1000–2200 SCF $H_2$ per barrel and 500°–800° F., preferably 600°–750° F. (315°–400° C.) temperature.

Particularly preferred is a splitter bottoms obtained when a nickel-tungsten on zeolite catalyst is used as the hydrocracking catalyst. There are many known types of hydrocracking catalysts, all of which serve to catalyze the cracking and hydrogenation of organic molecules in the feed stream. More recently developed hydrocracking catalysts are also capable of reducing the sulfur and nitrogen content in the feed so that the desired low-sulfur and low nitrogen petroleum fractions are obtained directly from the hydrocracker. It is preferred in accordance with the present invention to employ such recently-developed hydrocracking catalysts when hydrocracker distillate bottoms is used as the source for the high refractory petroleum fraction. Most preferred of such catalysts are nickel-tungsten or nickel-molybdenum supported on zeolite, nickel-tungsten on zeolite being especially preferred. Such catalysts are well known and described inter alia in Australian Pat. No. 13,913/66; U.S. Pat. No. 3,694,345; Canadian Pat. No. 892,014 and U.S. Pat. No. 3,959,180.

Regardless of its source, the high refractory petroleum fraction used in compounding the base oil should have the combination of properties specified in Table 2 above. Oftentimes, however, the effluent derived from a catalytic cracker and/or a hydrocracker as described above will contain too many light components to meet all of these requirements. Thus it may be necessary in some instances to distill off the light components of these streams in order to make a refractory petroleum fraction of appropriate properties. Distillation can occur before, intermediately or after the conventional finishing steps, i.e. dewaxing, dearomatization and clay contacting.

To meet the stability requirements of a 5W-40 oil, the high refractory fraction must contain at least 5% of the recycle splitter bottoms material, and can contain any amount between 5–100 volume percent, preferably about 8–10%. In actual operation the recycle splitter bottoms, optionally supplemented with up to 95 volume % of atmosphere reduced crude, is distilled in a vacuum distillation tower. From this tower is withdrawn the base oil stocks of the appropriate viscosity which can be further processed by dewaxing, solvent-extracting, and clay-contacting. The preferred viscosity for the high refractory fraction is about 75 to 90 SUS at 100° F.

B. SEN Oil Fraction

The other component of the base oil of the inventive motor oil is a solvent extracted neutral (SEN) mineral oil fraction characterized by having the combination of properties set forth in the following Table 3.

TABLE 3

| SEN OIL FRACTION PROPERTIES | General | Preferred |
|---|---|---|
| Minimum 210° F. (98.9° C.) Viscosity, cs | 4.8 | 7.3 |
| Minimum 100° F. (37.8° C.) Viscosity, cs | 28.5 | 44.5 |
| Minimum 0° F. (−17.8° C.) Viscosity, poise | 11.5 | 24.4 |
| 5% Boil-off, Minimum Temperature | 700° F. (371° C.) | 725° F. (385° C.) |
| 95% Boil-off, Minimum Temperature | 880° F. (471° C.) | 935° F. (501.7° C.) |

The SEN oil to be used in this invention must have the above general properties. Preferred SEN oils will have one or more improvements in viscosity or boil-off temperature characteristics. For example, 5% boil-off at minimum temperature means that no more than 5% of the oil will be volatilized at 700° F., while a preferred SEN oil fraction would have no more than 5% volatilized when the oil reached 725° F.

An SEN oil which has been found to be particularly useful in accordance with the present invention is SEN-140. "SEN-140" means a solvent extracted neutral oil having a viscosity of 140 SUS at 100° F. (37.8° C.). Other SEN oils, including mixtures, can be used.

In a preferred embodiment of the present invention, the SEN oil fraction of the base oil is composed of a mixture of two or more different SEN oils. For example, it has been found beneficial to employ a combination of SEN-140 with up to 70% SEN-300, the percent being based on the total amount by weight of SEN oil. Preferably, the SEN oil fraction is composed of 40 to 60% SEN-140 and 60 to 40% SEN-300. Most preferably, this fraction is composed of about 50% SEN-140 and 50% SEN-300. Any other combination of specific SEN oils can be employed to produce the SEN fraction of the base oil provided that the total SEN oil component has the combination of properties set forth in Table 3 above.

The completed base oil should contain 30 weight percent or more of the high refractory petroleum fraction and 70% or less of the SEN oil fraction. Preferably, the completed base oil contains about 30–50 weight percent of the high refractory petroleum fraction and 70–50 percent of the SEN oil fraction. More preferably, the base oil contains about 60 weight percent of the high refractory petroleum fraction and about 40 weight percent of the SEN oil fraction, which SEN oil fraction is itself composed of about 50% SEN-140 and 50% SEN-300. In the most preferred embodiment, the completed base oil contains about 20% SEN-140, 20% SEN-300 and 60% high refractory fraction derived from the bottom products of a 2-stage hydrocracker using a nickel-tungsten on zeolite first-stage catalyst.

The completed base oil of the inventive motor oil has a unique combination of properties making it ideally suitable for use in a 5W-40 motor oil. The completed base oil has a viscosity at 300° F. of at least about 1.5, preferably 2.0 and most preferably about 2.4 cs. The completed base oil should contain at least 80% and preferably at least 90% saturated hydrocarbons. The base oil has less than 60 ppm, preferably less than 45 ppm and more preferably less than 35 ppm basic nitrogen as measured by the Dohrman test.

II. V.I. IMPROVER

The second component of the inventive motor oil is a viscosity index (V.I.) improver, V.I.-improvers are components of lubricants which serve to decrease the viscosity changes in a lubricant with changes in temperature. Many different polymers are known to function as V.I. improvers. See for example, Smalheer et al., *Lubricant Additives,* The Lezium-Hiles Company (1967) pages 8 and 9.

A. Polymer Component of V.I. Improver

Of the many compounds known to be useful as V.I. improvers, alkyl methacrylate copolymers are recognized as having especially beneficial V.I. improver properties. Within this class, interpolymers of a short chain alkyl methacrylate, a long chain alkyl methacrylate and N,N-dialkylaminoalkyl methacrylate and/or methacrylamide (the alkyls of the dialkylaminoalkyl moiety having 1 to 6 carbon atoms) are particularly beneficial. Such interpolymers are well known and described inter alia in U.S. Pat. No. 4,036,766, U.S. Pat. No. 4,036,767 and U.S. Pat. No. 4,036,768, the disclosures of which are incorporated herein by reference.

V.I. improvers containing amine nitrogen (e.g. dialkylaminoalkyl methacrylate or methacrylamide) have a further benefit in that they function as a dispersant. By using such V.I. improvers it is possible to reduce the amount of dispersant that also must be included in the motor oil. Since dispersants are extremely viscous in nature, the use of active V.I. improvers allows a reduction in the amount of dispersant which in turn allows a low viscosity motor oil to be realized with a given viscosity.

In accordance with the present invention, the VI improver can be any known viscosity index improver that will provide SAE 5W and SAE 40 characteristics when used in combination with the base oil described above. The preferred V.I. improver is an interpolymer of a short chain alkyl methacrylate, a long chain alkyl methacrylate and an N,N-dialkylaminoalkyl methacrylamide (the alkyls of the dialkylaminoalkyl moiety having 1 to 6 carbon atoms). This interpolymer preferably has a molecular weight of about $5\times10^4$ to $10^6$ and normally contains 1 to 10 weight percent N,N-dialkylaminoalkyl methacrylamide, 15 to 30 weight percent short chain alkyl methacrylate and 60 to 84 weight percent long chain alkyl methacrylate. More preferably, the interpolymer contains 1 to 10 weight percent N,N-dialkylaminoalkyl methacrylamide, 15 to 30 weight percent short chain alkyl methacrylate, 40 to 60 weight percent $C_{10}$–$C_{14}$ alkyl methacrylate and 15 to 30 weight percent $C_{16}$–$C_{20}$ alkyl methacrylate. In this interpolymer, it is also preferred that the methacrylamide monomer be N,N-di($C_1$–$C_2$) alkylamino ($C_1$–$C_5$) alkyl methacrylamide. Most preferably, the methacrylamide monomer is N,N-dimethylaminoethyl methacrylamide.

An interpolymer especially useful in the invention has been analyzed by NMR spectroscopy and found to contain 4 mole percent dimethylaminoethyl methacrylamide, 21 mole percent short chain alkyl methacrylate (the short chain alkyl most probably being butyl) and 75 mole percent long chain alkyl methacrylate with the average chain length of all the methacrylate alkyls being 10.1 and the average chain length of the methacrylate long chain alkyls being 11.7.

For the purposes of this patent, "copolymer" means a polymer of two or more copolymerized monomers and "interpolymer" means a polymer of three or more copolymerized monomers. Also, "short chain" alkyl refers to alkyls having 6 or less carbon atoms and "long chain" alkyl refers to alkyls having 10 or more carbon atoms. The "short" and "long" chain designations are derived from NMR spectroscopy which is capable of discerning individual —$CH_2$ groups in chains of less than 8 carbon atoms but only the chains themselves when the chain contains 8 or more carbon atoms. Methacrylates containing $C_7$–$C_9$ alkyls are essentially unavailable as a practical matter and thus "short" and "long" designations refer to $C_1$–$C_6$ alkyls and $C_{10+}$ alkyls (usually $C_{10}$–$C_{20}$), respectively. Also, for the purposes of this patent, it will be understood that reference to a particular type of monomer includes mixtures of that type of monomer. For example, "a polymer containing a short chain alkyl methacrylate" will be understood as including polymers containing two or more different short chain alkyl methacrylates.

B. Solvent Component of VI improver

Polymeric V.I. improvers are normally formed by solution polymerization using various solvents, normally SEN oils such as, for example, SEN-100. It is in this form, i.e. in solution, that V.I. improvers are usually supplied to motor oil formulators, and it is in this form that V.I. improvers are usually blended with the other components of the motor oils.

In accordance with the present invention, it has been found that when formulating an extended drain SAE 5W-40 motor oil with a V.I. improver package (polymers+solvent) it is necessary to use as the solvent one having a relatively low volatility. In this connection, the amount of V.I. improver package (polymers+solvent) in conventional multi-grade motor oils as well as the inventive motor oils is usually on the order of 8–14% by weight. Normally, the amount of solvent in a V.I. improver package is about 60–65% by weight of the total package, and a finished oil will thus contain on the order of 6% V.I. improver solvent. If the V.I. improver solvent has a high volatility, it will be quickly lost in use and the oil will thus be unable to maintain its SAE 5W characteristics for an extended period of time. By using a low volatility oil as the medium for forming and supplying the V.I. improver polymer, this problem is essentially eliminated.

Any organic solvent having a minimum volatility of 680° F., preferably above 700° F., and which is otherwise suitable for preparing the V.I. improver polymer can be used as the V.I. improver solvent. Various different synthetic oils are useful for this purpose. For example, such solvents as bis(2-ethylhexyl) azelate, a liquid poly(alkene-1) of a molecular weight between about 200 and 10,000 as described in aforementioned U.S. Pat. No. 4,036,766 and U.S. Pat. No. 4,036,767, and a liquid alkyl benzene of a molecular weight between about 100 and 5000 as disclosed in the aforementioned U.S. Pat. No. 4,036,768 can be used. Bis(2-ethylhexyl) azelate is preferred.

Any amount of V.I. improver solvent can be employed, although as a practical matter the V.I. improver package should contain about 40 to 65, and preferably 50–65 weight percent solvent. Of course, no solvent need be used if desired, but use of a solvent makes formulating the inventive motor oil easier and hence is preferred.

III. DDI PACKAGE COMPONENT

The motor oil of the present invention has multifunctional additives of the type found in modern oil formulations. These additives are usually not added independently, but are precombined in DDI (detergent-dispersant-inhibitor) packages which can be otained commercially from suppliers of lube oil additives. DDI packages with a variety of ingredients, proportions and characteristics are available. The DDI package of the inventive motor oil has the composition and characteristics described more fully below.

Detergent-Dispersants

The term detergent-dispersant is sometimes used to characterize certain additives capable of performing both functions at appropriate temperatures. Separate detergent and dispersant additives may optionally be added, or a multifunctional additive can be used. Ashless dispersants as described below will often have some detergent capabilities.

Detergent additives act to prevent precipitation and buildup of deposits on internal engine parts, such as carbon in piston ring grooves, lacquer on pistons and sludge in engine sump. These additives are normally oil soluble metal soaps of thiophosphonates, sulphonates or sulfurized phenates.

It is possible to formulate the inventive motor oil without any detergent at all in the DDI package. As explained below, the dispersant will function to keep most of the undesirable materials dispersed throughout the oil. An oil formulation which contains no detergent will tend to be more stable over extended use, and is preferred. Detergents eventually degrade over use into smaller components which polymerize and produce an undesirable increase in viscosity. Although a detergent can be omitted, the inventive motor oil can contain a detergent, preferably ashless, in an amount equal to or less than the amounts commonly used in modern motor oil formulations.

Commercially available DDI packages are often with formulated with a detergent such as calcium phenate which serves to keep the accompanying additives suspended in the base oil of DDI package during shipment and storage. A suitable detergent in such a DDI package consists of about 50% calcium phenate mixed with calcium sulfonates, and a more preferred formulation contains up to 100% calcium phenate. Alkyl substituents of the calcium phenate ring structure generally comprise a mixture of $C_3$, $C_5$ and $C_8$ groups. The preferred form of calcium phenate for use in this invention has $C_3$ and $C_5$ alkyl substituents on the ring structure in about a 1:1 ratio of $C_3$ to $C_5$ groups.

If the DDI package does contain a detergent, it must not consist of or contain any material which would interfere with the overall desired characteristics of a long-drain 5W-40 oil. For example, magnesium sulfonate should not be used because it has a deleterous effect on extended life of the oil.

Dispersant additives are important in order to remove sludge in engines operated for short periods at relatively low temperatures. A mixture of combustion products, uncombusted fuel, carbon, anti-knock compounds and water can deposit on engine parts and form sludge which will interfere with efficient engine operation unless maintained in a fine dispersion. Although detergents can effectively reduce deposits in engines operated for long periods of time at high temperatures, ashless dispersants are needed for engines operated for short periods at low temperatures. Ashless dispersants are metal-free organic compounds which typically contain one or more nitrogen-containing groups to provide the dispersant capability. Certain ashless dispersants, especially copolymers, provide both dispersant and V.I.-improving characteristics because they are highly viscous.

In a preferred embodiment of this invention, the ashless dispersants are N-substituted long chain-alkenyl succinimides. Most of these dispersants contain a polyisobutene chain with from 50 to 200 or more carbons as the alkenyl radical. The substituent group on the imide nitrogen can vary, and can include a primary amide or preferably a secondary amide which will result in good thermal stability and dispersancy.

An extended-drain oil formulation generally needs a relatively large amount of dispersant in order to keep the increasing amounts of contaminants dispersed in the oil. However, the combination of large amounts of highly viscous dispersant with most V.I. improvers which have high viscosity at both high and low temperatures produces an oil having an overall viscosity too high to meet 5W requirements when added to known base oils. Certain alternative formulations gave unsatisfactory performance in one or more areas. For example although V.I. improvers are available with a lower molecular weight and lower viscosities, the shear stability of the polymers in such V.I. improvers is poor. The reduced viscosity of the inventive oil was achieved by decreasing the amount of excess viscosity in the DDI package, which is a large contributor to the overall viscosity. DDI package viscosity was reduced by decreasing the amount of dispersant used.

In formulating a 5W-40 oil which meets the standard SE and SF tests for sludge, rust and wear control it was found that a minimum amount of total nitrogen (i.e. about 0.10 percent by weight based upon weight of the completed motor oil) is necessary to provide dispersability. However, a motor oil having a DDI package containing the amount of nitrogen necessary to pass these tests often was too viscous for a 5W-40 oil with the desired low temperature viscosity characteristics. This viscosity was largely due to the amount of dispersant that was apparently needed to reach this result. When the V.I. improver contained amine groups as a partial source of the nitrogen, it was found that the oil had a unacceptably high consumption rate. Instead of using VI improvers containing amine groups, amides were used to provide the necessary nitrogen. The preferred amides of the V.I. improver have been described above.

It was discovered that the nitrogen in the V.I. improver could supplement the nitrogen in the dispersant, which allowed use of a smaller amount of dispersant to achieve the same effect. The source of the nitrogen in this motor oil is thus both the ashless dispersant and the V.I. improver. Generally, the dispersant concentration is from about 3.75 weight percent to about 5 percent of the total motor oil. A preferred formulation has about 4.

Inhibitors

Inhibitors protect engine parts by preventing undesirable chemical reactions of the materials present. Common additives include rust and corrosion inhibitors, wear inhibitors and oxidation inhibitors.

A successful oil formulation should contain effective amounts of these inhibitors, especially if it is to protect the engine completely until the oil is finally drained and replaced. However, effective quantities of some known inhibitors contain high levels of phosphorus and other elements which prevent their use in modern multi-grade extended-drain oils. Low-phosphorus inhibitors are desirable in order to keep overall phosphorus to a minimum, preferably less than 0.14 weight percent.

One additive that is well known for its anti-wear and anti-oxidation properties comprises zinc dialkyldithiophosphate (ZDDP). It is believed to function by inactivating the hydroperoxide radicals which are formed upon oxidation of the mineral oil hydrocarbons, thus preventing propagation of additional hydrocarbon radicals. This in turn prevents the formation of carbonaceous deposits on metal parts or their corrosion by components of the oxidized materials.

The completed motor oil of the present invention preferably contains ZDDP. The alkyl groups of the dialkyldithiophosphate can be any groups which will give the desired thermal stability and dispersant capabilities to the completed oil. Examples of suitable substituent groups are the straight or branched hydrocarbons containing from between three and eight, and occasionally 10 carbon atoms, or mixtures of the above. The choice of the appropriate alkyl group can readily be made by those skilled in the art. For example, it is known that the lower alkyls ($C_3$ to $C_5$) give better wear protection, while the higher alkyl groups ($C_6$ and above) provide better thermal and oxidation stability. The effect of the alkyl group size is known to vary depending on the particular base oil used. A skilled artisan can readily determine by standard testing the specific alkyl substituents to be used with a given base oil. It is preferred for the present oil to use alkyl substituents containing from 3 to 5 carbons. It is more preferred to use a "mixed alkyl", i.e., a ZDDP that has more than one size of alkyl group as a substituent. It is most preferred to use a mixed alkyl with a 1:1 ratio of $C_3$ to $C_5$ groups.

It is also a common practice to include rust inhibitors. Such additives prevent the formation of rust on internal surfaces, especially when the engine is operated in colder climates where water condensation is a problem. Common additives known to those skilled in the art include low molecular weight succinimides, long chain aliphatic esters, sulphonates, and amine phosphates. Although the presence of rust inhibitors is not critical to the invention, it is preferred to add an alkyl succinimide polymer about 0.75 volume percent based on the total volume of the completed oil. Corrosion inhibitors, especially those designed for use with ashless motor lubricants, can optionally be added.

Common DDI packages suitable for use with the inventive formulation contain components in the following weight percents: zinc 1.2 to 1.4; phosphorus 1.1 to 1.4; sulfur 4.7 to 5.8; nitrogen 0.8 to 1.1 and calcium 1.7 to 1.8, although formulations which further minimize the percentages of these elements and still maintain effective amounts of the desired DDI additive are more preferred. A completed 5W-40 motor oil was analyzed and found to contain elements in the following weight percents: zinc 0.088, phosphorus 0.082, sulfur 0.48, nitrogen 0.10 and calcium 0.12.

SPECIFIC EMBODIMENTS

EXAMPLE

A 1000 barrel batch of 5W-40 motor oil was made which consisted of 78 weight percent of the base oil described above and 22 wt % additives.

The base oil consisted of 354 bbl of the high refractory fraction described herein, having a viscosity of 90 SUS at 100° F. The SEN fraction consisted of 296 bbl SEN-140 and 140 bbl SEN-300.

The base oils were combined and mixed at 140° F. for about 30 minutes. Then 65 bbl of the preferred VI-improver described above, commercially available as Texaco TLA 541, was added to the base oil blend and mixed at 140° F. for 30 minutes. About 145 bbl of the preferred detergent-dispersant-inhibitor additive. Oronite OLOA 8210, was added to the above mixture and blended at 140° F. for 30 minutes.

The oil as blended above had the following characteristics:

100° C. viscosity—16.09 centistokes
40° C. viscosity—79.12 centistokes
18.7° C. viscosity—12.5 poises
−25° C. viscosity—27.6 poises
Borderline pumping—less than −35° C.
Zinc, wt %—0.091
Phosphorus, wt %—0.079
Sulfur, wt %—0.44
Calcium, wt %—0.12
Acid Number—1.299 mg KOH/g
Base Number—6.866 mg KOH/g
Ash, wt % $SO_4$—0.577
Flash point—415° F.
Pour point—−40° F.

I claim:

1. A base oil blend suitable for producing a natural petroleum motor oil with 5W-40 characteristics, the blend comprising fractions (A) and (B) wherein:

(A) is at least 30 weight percent of the blend and is a high refractory petroleum fraction comprising at least 5 volume percent of a hydrocracker distillate bottoms obtained by distilling the effluent of a hydrocracker using a catalyst capable of reducing the sulfur and nitrogen content, and withdrawing the bottoms having an initial boiling point between 400° to 400° F., and (B) is present in an amount up to 70 weight percent of the blend and is an SEN oil fraction consisting of at least one SEN oil.

2. The blend of claim 1 in which the catalyst is selected from the group consisting of Ni-W and Ni-Mo.

3. The blend of claim 2 in which the catalyst is Ni-W supported on zeolite.

4. The blend of claim 3 in which the hydrocracker distillate bottoms comprises about 8 to 100 volume percent of fraction (A).

5. The blend of claim 4 in which about 10 volume percent of the hydrocracker distillate bottoms is subjected to further hydrocracking in a second stage hydrocracker.

6. The blend of claim 4 in which fraction (A) is obtained by introducing about 5 to 100 volume % of a hydrocracker distillate bottoms and 0 to about 95% of an atmospheric reduced crude to a vacuum distillation tower and withdrawing a fraction having a 100° F. viscosity of from 80 to 100 SUS.

7. The blend of claim 6 in which fraction (A) has the following properties, in combination:

maximum 0° F. viscosity: 7.0 poise
maximum 100° F. viscosity: 94 SUS
maximum 700° F. boil-off: 16%
maximum 760° F. boil-off: 70%
minimum viscosity index: 100.

8. The blend of claim 7 in which fraction (A) has the following properties, in combination:

maximum 0° F. viscosity: 6.0 poise
maximum 100° F. viscosity: 85 SUS
maximum 700° F. boil-off: 13%
maximum 760° F. boil-off: 60%
minimum viscosity index: 100.

9. The blend of claim 8 in which fraction (A) has the following properties, in combination:

maximum 0° F. viscosity: 5.0 poise
maximum 100° F. viscosity: 85 SUS
maximum 700° F. boil-off: 10%
maximum 760° F. boil-off: 50%
minimum viscosity index: 100.

10. The blend of claim 1 in which fraction (B) comprises SEN-140.

11. The blend of claim 10 in which fraction (B) comprises a mixture of SEN-140 and SEN-300.

12. The blend of claim 11 in which fraction (B) consists of up to 70 weight percent SEN-300.

13. The blend of claim 12 in which fraction (B) consists of 40 to 60% SEN-140 and 60 to 40% SEN-300.

14. The blend of claim 13 in which fractiion (B) consists of about 50% SEN-140 and about 50% SEN-300.

15. The blend of claim 10 in which fraction (B) has the following properties, in combination:

minimum 210° F. viscosity: 4.8 centistokes
minimum 100° F. viscosity: 28.5 centistokes
minimum 0° F. viscosity: 11.5 poise
5% boil-off, minimum temp: 700° F.
95% boil-off, minimum temp: 880° F.

16. The blend of claim 15 in which fraction (B) has the following properties, in combination:

minimum 210° F. viscosity: 7.3 centistokes
minimum 100° F. viscosity: 44.5 centistokes
minimum 0° F. viscosity: 24.5 poise
5% boil-off, minimum temp: 725° F.
95% boil-off, minimum temp: 935° F.

17. The blend of claim 1 consisting of from 30 to 70 wt % of fraction (A) and 70 to 30 wt % of fraction (B).

18. The blend of claim 17 consisting of about 60 wt % of fraction (A) and about 40 wt % of fraction (B).

19. The blend of claims 1, 4, 6, 11, or 17 in which the 100° F. viscosity is less than 17.5 centistokes.

20. The blend of claim 19 in which no more than 10 volume percent of the blend is withdrawn by distillation at or below 685° F., no more than 30 volume percent is withdrawn at or below 725° F., and no more than 50 volume percent is withdrawn at or below 750° F.

21. The blend of claim 20 in which the 300° F. viscosity is at least 1.5 centistokes.

22. The blend of claim 11 in which the basic nitrogen content is less than 45 parts per million.

23. The blend of claim 22 which further comprises a V.I. improver.

24. The blend of claim 23 in which the V.I. improver is an alkyl methacrylate copolymer.

25. The blend of claim 24 in which the V.I. improver is an interpolymer of a short chain alkyl methacrylate, a long chain alkyl methacrylate and an N,N-dialkylaminoalkyl methacrylmide (the alkyls of the dialkylaminoalkyl moiety having 1 to 6 carbon atoms).

26. The blend of claim 25 in which the interpolymer contains 1 to 10 weight percent N,N-dialkylaminoalkyl methacrylamide, 15 to 30 weight percent short chain alkyl methacrylate, 40 to 60 weight percent $C_{10}$–$C_{14}$ alkyl methacrylate and 15 to 30 weight percent $C_{16}$–$C_{20}$ alkyl methacrylate.

27. The blend of claim 26 in which the methacrylamide monomer is N,N-di($C_1$–$C_2$) alkylamino ($C_1$–$C_5$) alkyl methacrylamide.

28. The blend of claim 27 in which the methacrylamide monomer is N,N-dimethylaminomethyl methacrylamide.

29. The blend of claim 23 in which the V.I. improver is contained in an organic solvent having a minimum volatility of 680° F.

30. The blend of claim 29 in which the minimum volatility of the solvent is 700° F.

31. The blend of claim 30 in which the solvent is bis(2-ethylhexyl) azelate.

32. The blend of claim 23 which further comprises a detergent-dispersant additive.

33. The blend of claim 32 which contains an ashless dispersant.

34. The blend of claim 33 in which the ashless dispersant is an N-substituted long chain-alkenyl succinimide containing a polyisobutene chain with from 50 to about 200 carbons as the alkenyl radical.

35. The blend of claim 23 which further comprises a corrosion-inhibitor additive having less than 1.4 wt % phosphorus.

36. The blend of claim 35 in which the corrosion inhibitor comprises zinc dialkyldithiophosphate.

* * * * *

UNITED STATES PATENT AND TRADEMARK OFFICE

CERTIFICATE OF CORRECTION

PATENT NO. : 4,402,841

DATED : September 6, 1983

INVENTOR(S) : Richard D. Schieman

It is certified that error appears in the above-identified patent and that said Letters Patent is hereby corrected as shown below:

In Claim 1, column 11 at line 5, "400° to 400°F" should read -- 400° to 450°F --.

Signed and Sealed this

Twentieth Day of November 1984

[SEAL]

*Attest:*

GERALD J. MOSSINGHOFF

*Attesting Officer*

*Commissioner of Patents and Trademarks*